US010709249B2

(12) United States Patent
Liu et al.

(10) Patent No.: US 10,709,249 B2
(45) Date of Patent: Jul. 14, 2020

(54) UPPER SLIDING ARM PORTION OF A LOUNGER CHAIR, AND A MOTORIZED MECHANISM FOR MOVING THE UPPER SLIDING ARM PORTION FORWARDLY SO AS TO COVER A STORAGE RECEPTACLE DEFINED WITHIN A LOWER FIXED ARM PORTION OF THE CHAIR, AND FOR MOVING THE UPPER SLIDING ARM PORTION REARWARDLY SO AS TO UNCOVER THE STORAGE RECEPTACLE

(71) Applicants: Chih Hsiung Liu, Benoni (ZA); Mei Jun Xu, Jiujiang (CN)

(72) Inventors: Chih Hsiung Liu, Benoni (ZA); Mei Jun Xu, Jiujiang (CN)

(73) Assignee: HHC CHANGZHOU CORPORATION, Changzhou (CN)

( * ) Notice: Subject to any disclaimer, the term of this patent is extended or adjusted under 35 U.S.C. 154(b) by 0 days.

(21) Appl. No.: 16/156,002

(22) Filed: Oct. 10, 2018

(65) Prior Publication Data

US 2020/0113335 A1 Apr. 16, 2020

(51) Int. Cl.
*A47C 7/54* (2006.01)
*A47C 7/62* (2006.01)

(52) U.S. Cl.
CPC ..... *A47C 7/541* (2018.08); *A47C 7/624* (2018.08)

(58) Field of Classification Search
CPC ..... A47C 7/541; A47C 7/624; A47C 7/622; A47C 7/543
USPC ..... 297/188.14, 188.19, 188.01, 411.35, 297/411.3, 411.2, 188.13
See application file for complete search history.

(56) References Cited

U.S. PATENT DOCUMENTS 6,045,173 A * 4/2000 Tiesler ..... B60N 3/102 296/37.8
7,794,000 B2 * 9/2010 Ichimaru ..... B60R 7/04 248/311.2

(Continued)

*Primary Examiner* — Milton Nelson, Jr.
(74) *Attorney, Agent, or Firm* — Law Offices of Steven W. Weinrieb

(57) ABSTRACT

The present invention relates generally to furniture, and more particularly to a chair, particularly a lounger chair, wherein at least one side arm portion of the chair is provided with a lower fixed arm segment, and an upper slidably movable arm segment. A storage receptacle for holding various devices, such as, for example, a book, magazine, remote control devices, a wireless charging pad, a dock, is fixedly secured within the lower fixed arm segment. Alternatively, the storage receptacle can comprise at least one cup holder for holding a beverage. The upper slidably movable arm segment is fixably mounted upon a slidable rail member, and a motorized mechanism is operatively connected to the slidable rail member for moving the slidable rail member and the upper arm segment fixedly secured thereto between a first forward position at which the upper arm segment is CLOSED so as to cover the storage receptacle or cup holder such that, for example, the storage receptacle or at least one cup holder is hidden from view, and a second rearward position at which the upper arm segment is OPEN so as to uncover the storage receptacle or cup holder such that access to the storage receptacle or at least one cup holder is permitted.

7 Claims, 5 Drawing Sheets

(56) References Cited

U.S. PATENT DOCUMENTS

| | | | | |
|---|---|---|---|---|
| 9,022,466 | B2 * | 5/2015 | Cinco | B60N 2/793<br>297/188.19 |
| 2013/0334919 | A1 * | 12/2013 | Welp | H02K 7/06<br>310/80 |

* cited by examiner

UPPER SLIDING ARM PORTION OF A LOUNGER CHAIR, AND A MOTORIZED MECHANISM FOR MOVING THE UPPER SLIDING ARM PORTION FORWARDLY SO AS TO COVER A STORAGE RECEPTACLE DEFINED WITHIN A LOWER FIXED ARM PORTION OF THE CHAIR, AND FOR MOVING THE UPPER SLIDING ARM PORTION REARWARDLY SO AS TO UNCOVER THE STORAGE RECEPTACLE

FIELD OF THE INVENTION

The present invention relates generally to furniture, and more particularly to a chair, particularly a lounger chair, wherein at least one side arm portion of the chair is provided with a lower fixed arm segment, and an upper slidably movable arm segment. A storage receptacle for holding various devices, such as, for example, a book, magazine, remote control devices, a wireless charging pad, a dock, is fixedly secured within the lower fixed arm segment. Alternatively, the storage receptacle can comprise at least one cup holder for holding a beverage. The upper slidably movable arm segment is fixably mounted upon a slidable rail member, and a motorized mechanism is operatively connected to the slidable rail member for moving the slidable rail member and the upper arm segment fixedly secured thereto between a first forward position at which the upper arm segment is CLOSED so as to cover the storage receptacle or cup holder such that, for example, the storage receptacle or at least one cup holder is hidden from view, and a second rearward position at which the upper arm segment is OPEN so as to uncover the storage receptacle or cup holder such that access to the storage receptacle or at least one cup holder is permitted.

BACKGROUND OF THE INVENTION

Lounger chairs are conventionally present within modern living rooms, family rooms, dens, libraries, offices or the like, of residential homes, condominiums, apartments, business offices, and the like. Lounger chairs are chairs wherein, for example, the back portion, the headrest, the seat portion, and a footrest of the chair are operatively connected together by means of a multitude of linkage members comprising an overall linkage system, and at least one motorized actuator is operatively connected to various linkage members comprising the linkage system so that predetermined movements of the back portion, the headrest, the seat portion, and the footrest of the chair are able to be achieved as desired. In short, lounger chairs are chairs where people are very comfortable sitting when they desire to, for example, read a book or magazine, watch television, use an electronic device so as to interact with friends or relatives upon social media platforms, and the like. Accordingly, it is also often the case that the person sitting in the chair desires to enjoy a beverage while participating within one or more of the aforenoted activities. While, for example, providing at least one storage receptacle or cup holder within at least one arm portion of the chair, the storage receptacle or cup holder is usually provided within an upper forward portion of the chair arm and is conventionally or normally open or exposed to the room environment. However, such an open disposition of the storage receptacle or cup holder presents several problems which some people may not like in connection with the overall décor of the aforenoted living rooms, family rooms, dens, offices, or libraries. For example, since the storage receptacle or cup holder is always open and exposed to the environment within the living rooms, family rooms, dens, or libraries, such storage receptacles or cup holders have a tendency to collect dust and become dirty. Still further, some people may consider such storage receptacles or cup holders aesthetically unpleasing in connection with the overall décor of the particular room, and may desire to have such storage receptacles or cup holders normally hidden and then rendered available for use when desired. Therefore, the storage receptacles or cup holders may be manually manipulable so as to be capable of being manually opened or closed as desired. However, this is not really desirable in view of the fact that the person sitting in the chair can readily adjust the back portion, the headrest, the seat portion, and the footrest components of the chair by means of a power unit having a multitude of control buttons which will actuate the at least one motorized actuator in order to achieve various positional adjustments of the back portion, the headrest, the seat portion, and the footrest components of the chair. Accordingly it is desirable for a segment of the chair arm to likewise be capable of being opened and closed by means of at least one motorized actuator. However, care must be taken when utilizing such a motorized actuator in that the closure of the arm segment cannot be too forceful or aggressive or else damage to the actuator motor, or a person's hand, if, for example, a foreign object or a person's hand should be interposed between the movable compartment or door and the chassis of the lounger chair, may occur. For example, if some foreign object becomes jammed in the system while the movable arm segment is disposed at its OPEN position, then safety measures must be incorporated within the system for effectively shutting down or preventing further closure of the arm segment until the foreign object, blocking the closure of the compartment or door, is firstly removed.

A need therefore exists in the art for a new and improved lounger chair. Another need exists in the art for a new and improved lounger chair wherein the lounger chair is provided with a storage receptacle or cup holder within at least one arm portion of the chair. Still another need exists in the art for a new and improved lounger chair wherein the storage receptacle or cup holder is mounted within an upper forward portion of at least one of the lounger chair arms and is adapted for holding various different objects such as, for example, a book, a magazine, remote control devices, a wireless charging pad, a dock, or a beverage. An additional need exists in the art for a new and improved lounger chair storage wherein the storage receptacle or the at least one cup holder is mounted upon an arm portion of the lounger chair and wherein an arm segment can be moved between a first CLOSED position and a second OPEN position with respect to the lounger chair such that the storage receptacle or the at least one cup holder can be normally hidden as a result of the movable arm segment being disposed at its CLOSED position and yet exposed when the movable arm segment is moved to its OPEN position when access to the storage receptacle is desired so as to gain access to the storage receptacle and its contents, or to the at least one cup holder. Still an additional need exists in the art for a new and improved lounger chair wherein the movable arm segment is moved between the aforenoted CLOSED and OPEN positions by means of at least one motorized actuator mechanism. A further need exists in the art for a new and improved lounger chair wherein the closure of the movable arm segment is regulated so that when the movable arm segment is moved from its OPEN position toward its CLOSED position, and is jammed due to some foreign object blocking the closure of the movable arm segment from its OPEN position toward its CLOSED position, the movement of the movable arm segment from its OPEN position toward its CLOSED position will be terminated for safety reasons until the foreign object is removed.

Overall Objectives of the Invention

An overall objective of the present invention is to provide a new and improved lounger chair. Another overall objective of the present invention is to provide a new and improved lounger chair wherein the lounger chair is provided with a storage receptacle or cup holder within at least one arm portion of the chair. Still another overall objective of the present invention is to provide a new and improved lounger chair wherein the storage receptacle or cup holder is mounted within an upper forward portion of at least one of the lounger chair arms and is adapted for holding various different objects such as, for example, a book, a magazine, remote control devices, a wireless charging pad, a dock, or a beverage. An additional overall objective of the present invention is to provide a new and improved lounger chair storage wherein the storage receptacle or the at least one cup holder is mounted upon an arm portion of the lounger chair and wherein an arm segment can be moved between a first CLOSED position and a second OPEN position with respect to the arm portion of the lounger chair such that the storage receptacle or the at least one cup holder can normally be hidden as a result of the movable arm segment being disposed at its CLOSED position and yet exposed when the movable arm segment is moved to its OPEN position when access to the storage receptacle is desired so as to gain access to the storage receptacle and its contents, or to the at least one cup holder. Still an additional overall objective of the present invention is to provide a new and improved lounger chair wherein the movable arm segment is moved between the aforenoted CLOSED and OPEN positions by means of at least one motorized actuator mechanism. A further a overall objective of the present invention is to provide new and improved lounger chair wherein the closure of the movable arm segment is regulated so that when the movable arm segment is moved from its OPEN position toward its CLOSED position, and is jammed due to some foreign object blocking the closure of the movable arm segment from its OPEN position toward its CLOSED position, the movement of the movable arm segment from its OPEN position toward its CLOSED position will be terminated for safety reasons until the foreign object is removed.

SUMMARY OF THE INVENTION

The foregoing and other objective are achieved in accordance with the principles and teachings of the present invention through the provision of a new and improved lounger chair which comprises a seat portion, a backrest portion, and at least one arm portion. The arm portion of the lounger chair is intended to have a storage receptacle or a cup holder formed within the upper forward section of the arm portion of the lounger chair for storing various objects that a person, sitting in one of the lounger chairs, may choose to use, such as, for example, a book, a magazine, remote control devices, a wireless charging pad, a dock, or a beverage. The location of the storage receptacle or cup holder, as mounted within at least one arm portion of the lounger chair, renders the availability of the various objects, such as the aforenoted book, magazine, remote control devices, wireless charging pad, dock, or a beverage, convenient for the person sitting in the lounger chair. More particularly, the arm portion of the chair is provided with a lower fixed arm segment, and an upper slidably movable arm segment. A storage receptacle for holding various devices, such as, for example, a book, magazine, remote control devices, a wireless charging pad, a dock, is fixedly secured within the lower fixed arm segment. Alternatively, the storage receptacle can comprise at least one cup holder for holding a beverage. The upper slidably movable arm segment is fixably mounted upon a mounting plate which, in turn, is fixedly attached to a slidable rail member which is slidably movable upon a fixed support plate, and a motorized mechanism is operatively connected to the slidable rail member for moving the slidable rail member and the upper arm segment fixedly secured thereto between a first forward position at which the upper arm segment is CLOSED so as to cover the storage receptacle or cup holder such that, for example, the storage receptacle or at least one cup holder, is hidden from view, and a second position at which the upper arm augment is moved to a second rearward position at which the upper arm segment is OPEN and thereby uncovers the storage receptacle or cup holder such that access to the storage receptable or at least one cup holder is permitted.

The motorized mechanism or actuating system for moving the upper arm segment from the CLOSED position to the OPEN POSITION and back to the CLOSED position may comprise one of two different embodiments, the CLOSED position being the normal state when the actuator mechanism is actuated. In accordance with a first embodiment, a rotary driven screw-threaded actuator mechanism comprises an actuator housing from which a threaded rod is extended axially when the actuator mechanism is rotated in a first direction by means of a bi-directional drive motor. Accordingly, when the distal end portion of the threaded rod encounters a dependent mounting bracket which is fixedly mounted upon or connected to the slidably movable upper arm segment, the distal end portion of the threaded rod will cause the slidably movable arm segment, fixedly mounted upon the slidable rail, to move forwardly whereby the upper slidably movable arm segment will be moved to its CLOSED position such that the storage receptacle or at least one cup holder will be covered and thereby hidden from view. A return spring is fixedly secured at one end to the actuator housing and is likewise fixedly secured at its opposite end to the dependent mounting bracket. Accordingly, when the bi-directional drive motor is rotated in the opposite or reverse direction, the threaded rod will be retracted into the actuator housing, thereby permitting the biasing spring to move the movable arm segment rearwardly to its OPEN position. Safety is inherently built into this system in view of the fact that if some foreign object becomes interposed between the open arm segment and any component part of the housing or chassis of the lounger chair, the return spring is not strong enough to overcome the interdisposition of the foreign object between the movable arm segment and the housing or chassis of the lounger chair so as to move the movable arm segment to its OPEN position. Accordingly, the drive motor will be deactivated until the foreign object has been removed. This safety feature prevents any harm being done to the foreign object, which could be animate or inanimate, until the same is removed from its obstructive disposition between the movable arm segment and the housing or chassis of the lounger chair.

In accordance with a second embodiment of the actuating mechanism, a rotary driven screw-threaded actuator mechanism likewise comprises an actuator housing from which a threaded rod is extended axially when the actuator mechanism is rotated in a first direction by means of a bi-directional drive motor, and wherein the distal end portion of the threaded rod is operatively connected to the dependent mounting bracket fixedly mounted upon the upper slidable arm segment. When the threaded rod is fully extended, the upper sidable arm segment will be moved forwardly to its CLOSED position whereby the same covers the cup holder. However, because the distal end portion of the threaded rod is operatively connected to the mounting bracket fixedly mounted to the upper slidable arm segment, the return spring of the first embodiment of the actuating mechanism has been eliminated so as not to be capable of moving the upper slidable arm segment back to its normal OPEN position. Therefore in accordance with this second embodiment of the actuating mechanism, the drive motor is electronically monitored by means of a suitable power control unit which monitors the RPM of the motor as well as the amperage drawn by the drive motor. If either of these parameters exceeds the limits pre-programmed into the control unit, which would indicate that the rotary drive motor is attempting to drive the threaded rod with greater power so as to, for example, overcome an obstacle that may have become interposed between the upper slidable arm segment and the arm portion of the lounger chair, the rotary drive of the drive motor is immediately reversed or terminated until the foreign object has been removed. This safety feature therefore operates in a similar manner so as to prevent the drive motor from being burned out due to excessive operation beyond acceptable power limits, and also prevents any harm being done to the foreign object, which could be animate or inanimate, until the same is removed from its obstructive disposition between the upper slidable arm portion and the arm portion of the chair.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein:

FIGS. 3*a* and 3*b*, is illustrated as being operatively connected to the slidable rail member so as to move the same, along with the upper slidably movable arm section, rearwardly such that the upper slidably movable arm section is disposed at its OPEN position at which the storage receptacle or cup holder is uncovered and accessible; FIGS. 4*a* and 4*b*, is illustrated as being operatively connected to the slidable rail member so as to move the same, along with the upper slidably movable arm section, forwardly such that the upper slidably movable arm section is disposed at its CLOSED position at which the storage receptacle or cup holder is covered and inaccessible.

DETAILED DESCRIPTION OF THE ILLUSTRATED EMBODIMENTS

Figure 1:
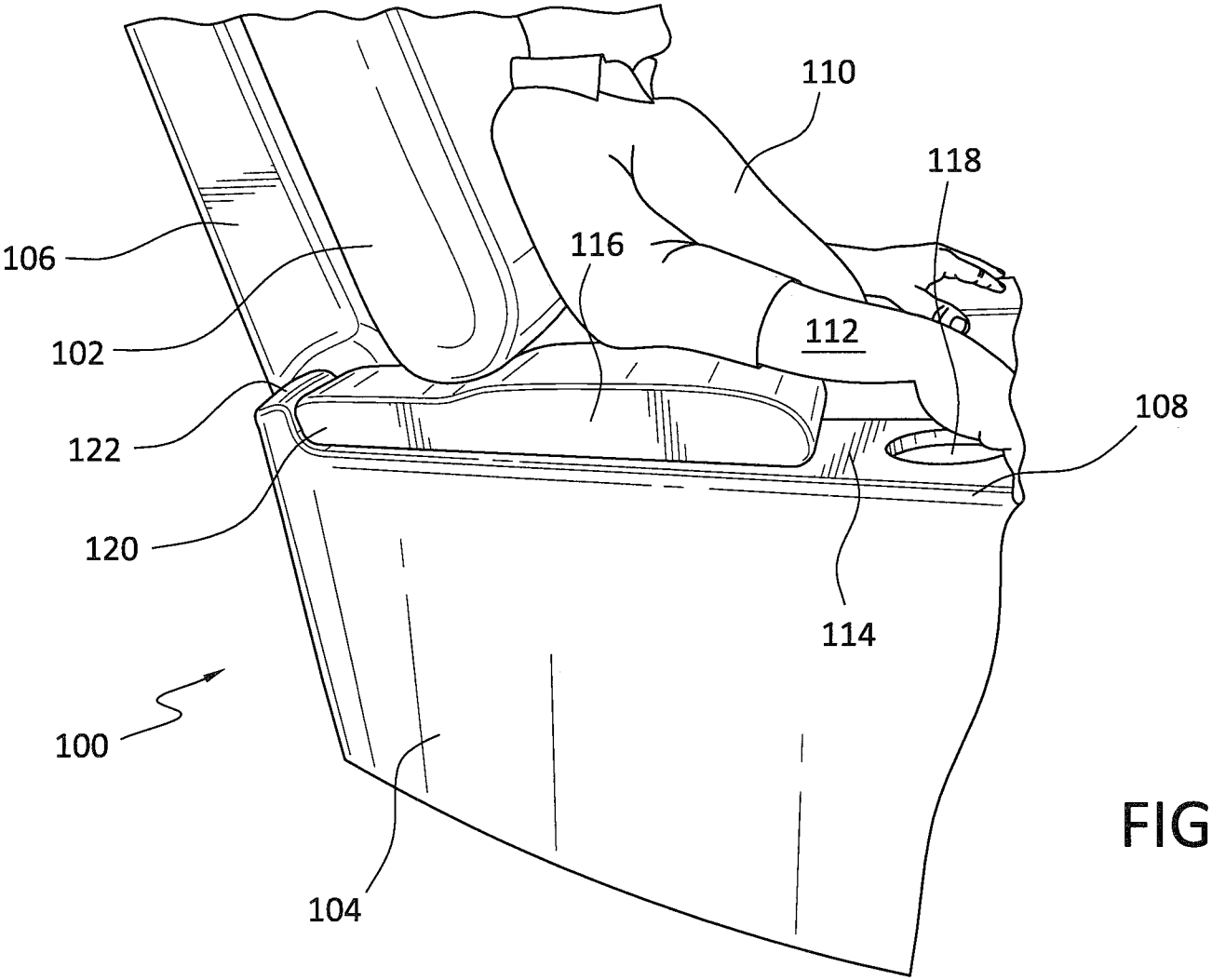
FIG. 1 is a side perspective view of a lounger chair wherein it can be seen that an upper slidably movable arm segment of one side arm of the lounger chair has been moved forwardly to its CLOSED position at which the upper slidably movable arm segment of the one side arm of the lounger chair covers a storage receptacle or cup holder formed within a forward end portion of a lower fixed arm segment of the one side arm of the lounger chair such that the storage receptacle or cup holder is hidden from view.
Figure 2:
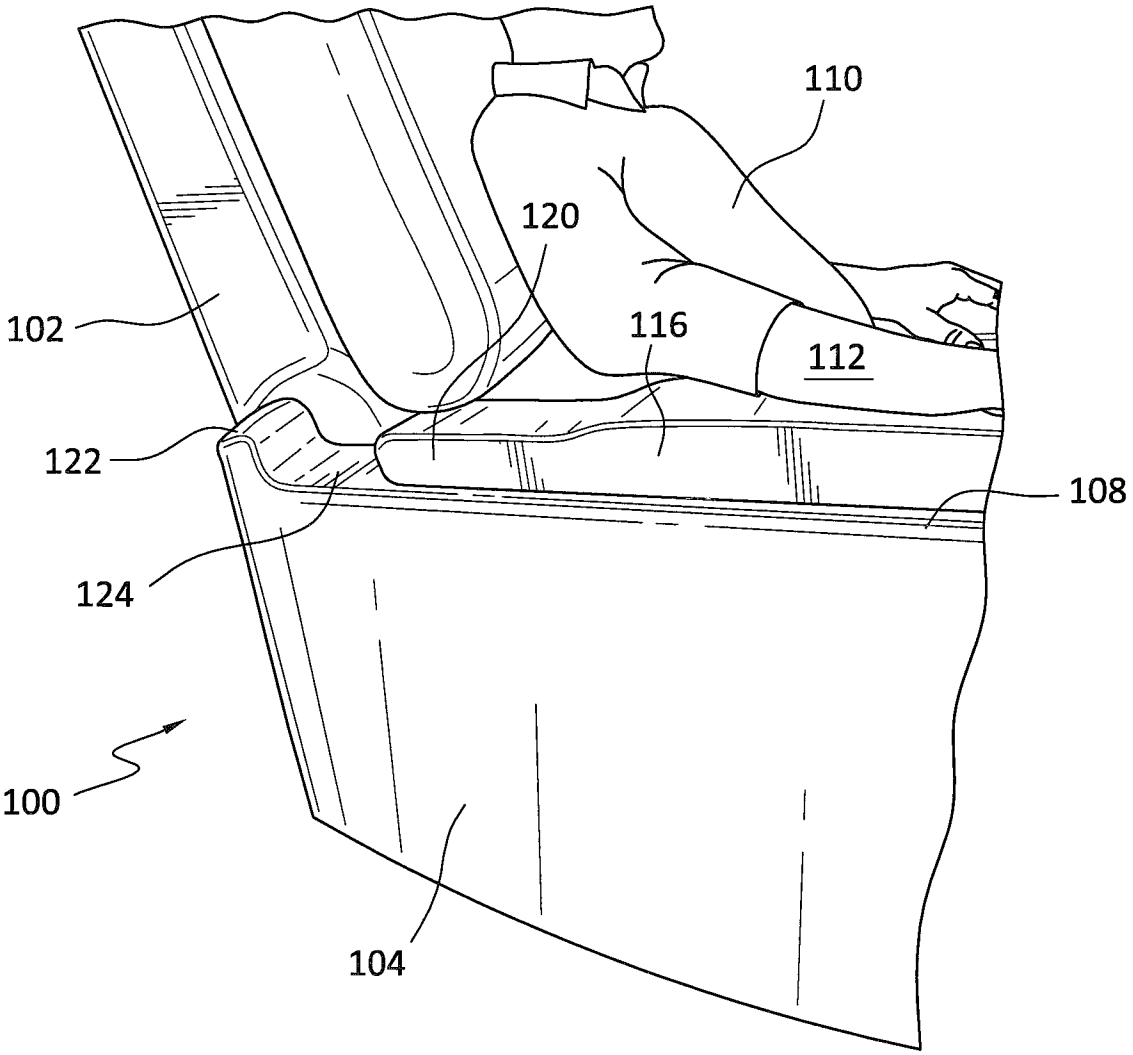
FIG. 2 is a side perspective view of a lounger chair, similar to that of FIG. 1, wherein it can be seen that the upper slidably movable arm segment of the one side arm of the lounger chair has been moved rearwardly to its OPEN position at which the upper slidably movable arm segment of the one side arm of the lounger chair uncovers the storage receptacle or cup holder formed within the forward end portion of the lower fixed arm segment of the one side arm of the lounger chair such that the storage receptacle or cup holder is readily accessible.
Figure 3A:
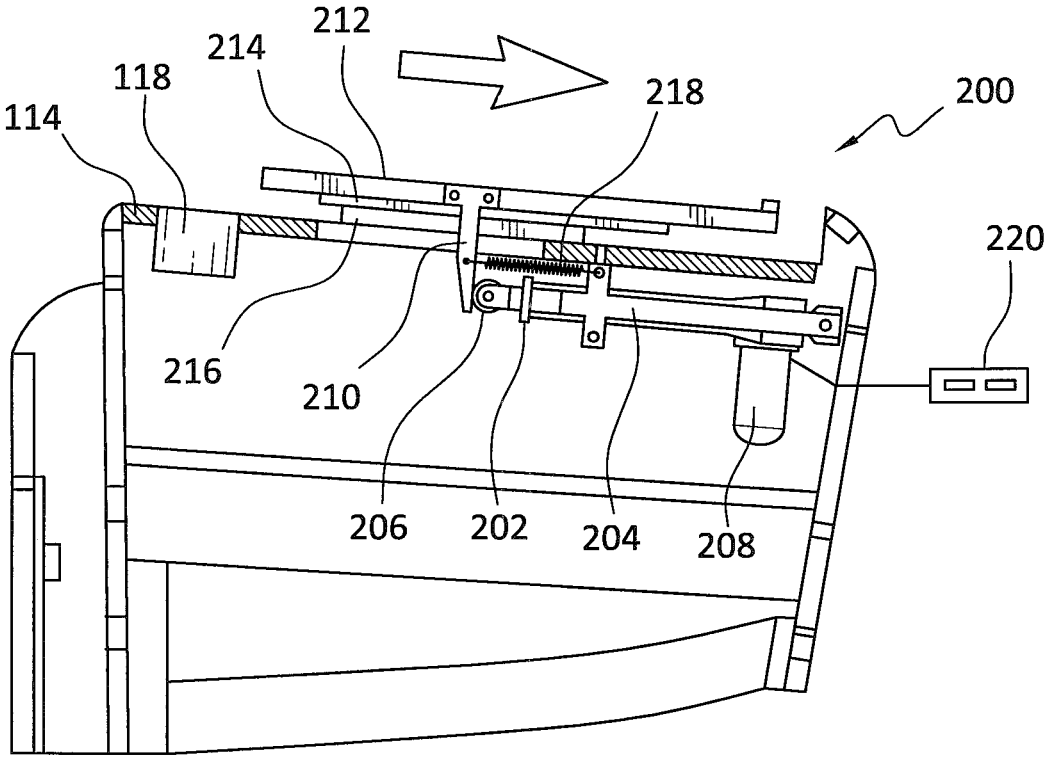
FIG. 3*a* is a schematic cross-sectional view of a first embodiment of an actuating mechanism to be utilized in conjunction with the lounger chairs as disclosed within FIGS. 1 and 2, wherein the upper slidably movable arm segment, fixedly secured to the slidably movable rail member, is moved rearwardly by the return spring of the actuating mechanism such that the upper movable arm segment uncovers the storage receptacle or cup holder and is disposed at its normally OPEN position at which the storage receptacle or cup holder are accessible.
Figure 3B:
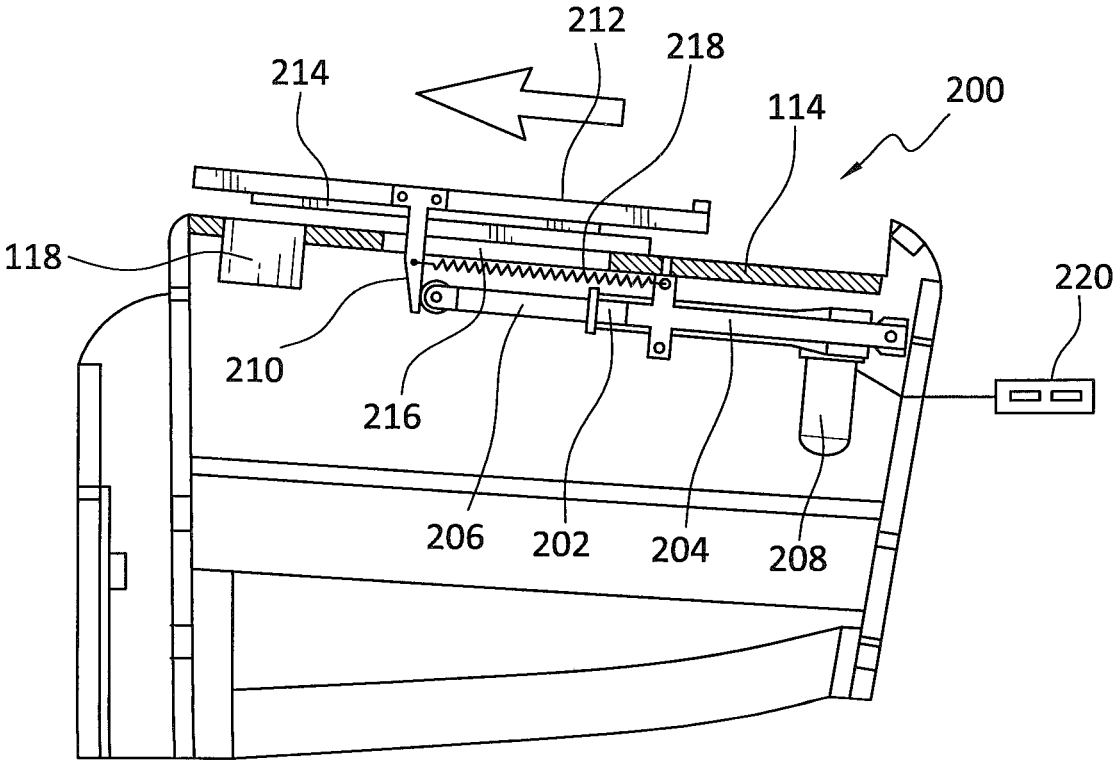
FIG. 3*b* is a schematic cross-sectional view of the first embodiment of the actuating mechanism to be utilized in conjunction with the lounger chairs as disclosed within FIGS. 1 and 2, wherein the actuating mechanism is similar to that as illustrated within FIG. 3*a* except for the fact that the actuating mechanism has moved the upper slidable arm segment forwardly to its CLOSED position at which the upper slidable arm segment covers the storage receptacle or cup holder such that the storage receptacle or cup holder are hidden from view and are therefore inaccessible.
Figure 4A:
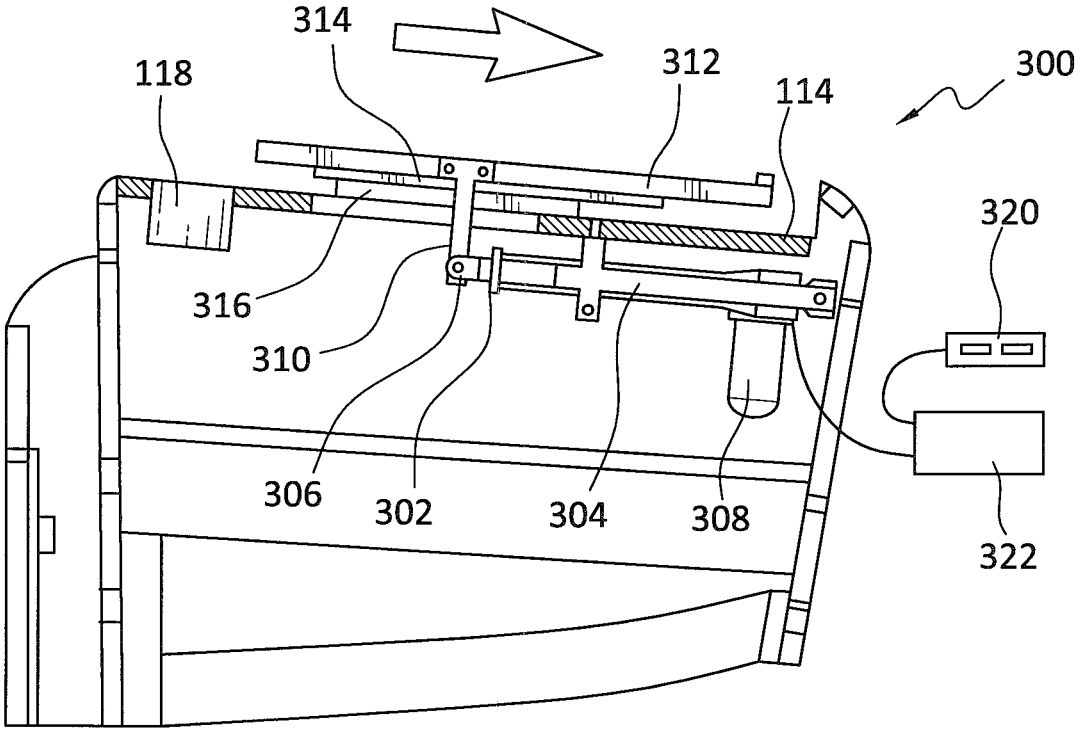
FIG. 4*a* is a schematic cross-sectional view of a second embodiment of the actuating mechanism to be utilized in conjunction with the lounger chairs as disclosed within FIGS. 1 and 2, wherein the upper slidably movable arm segment, fixedly secured to the slidably movable rail member, is moved rearwardly by a linear actuator of the actuating mechanism such that the upper movable arm segment uncovers the storage receptacle or cup holder and is disposed at its normally OPEN position at which the storage receptacle or cup holder are accessible.
Figure 4B:
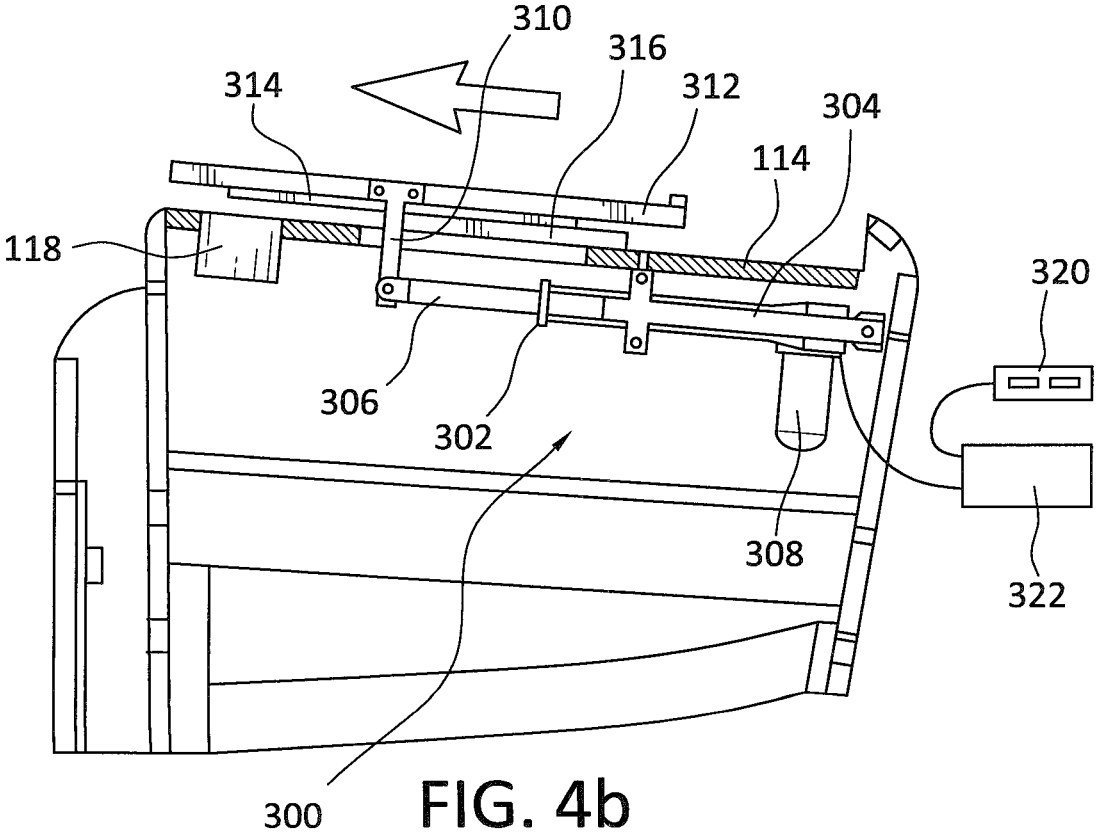
FIG. 4*b* is a schematic cross-sectional view of the second embodiment of the actuating mechanism to be utilized in conjunction with the lounger chairs as disclosed within FIGS. 1 and 2, wherein the actuating mechanism is similar to that as illustrated within FIG. 3*a* except for the fact that the actuating mechanism has moved the upper slidable arm segment forwardly to its CLOSED position at which the upper slidable arm segment covers the storage receptacle or cup holder such that the storage receptacle or cup holder are hidden from view and are therefore inaccessible.
Figure 5A:
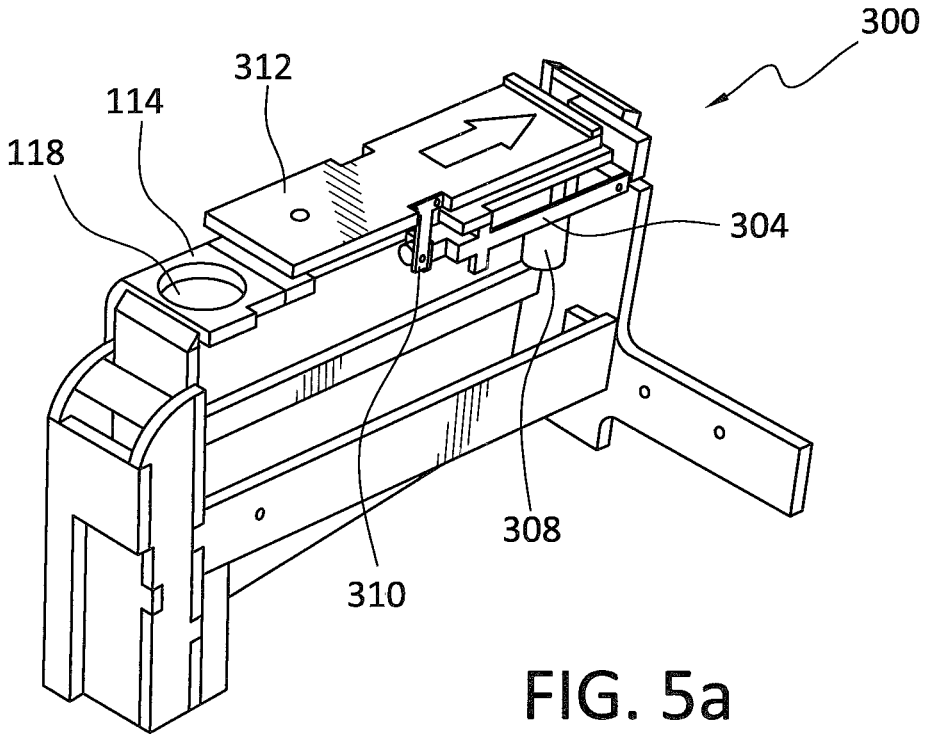
FIG. 5*a* is a schematic right side, front, top perspective view of the lounger chair as disclosed within FIGS. 4*a* and 4*b*, wherein the actuating mechanism, as disclosed within
Figure 5B:
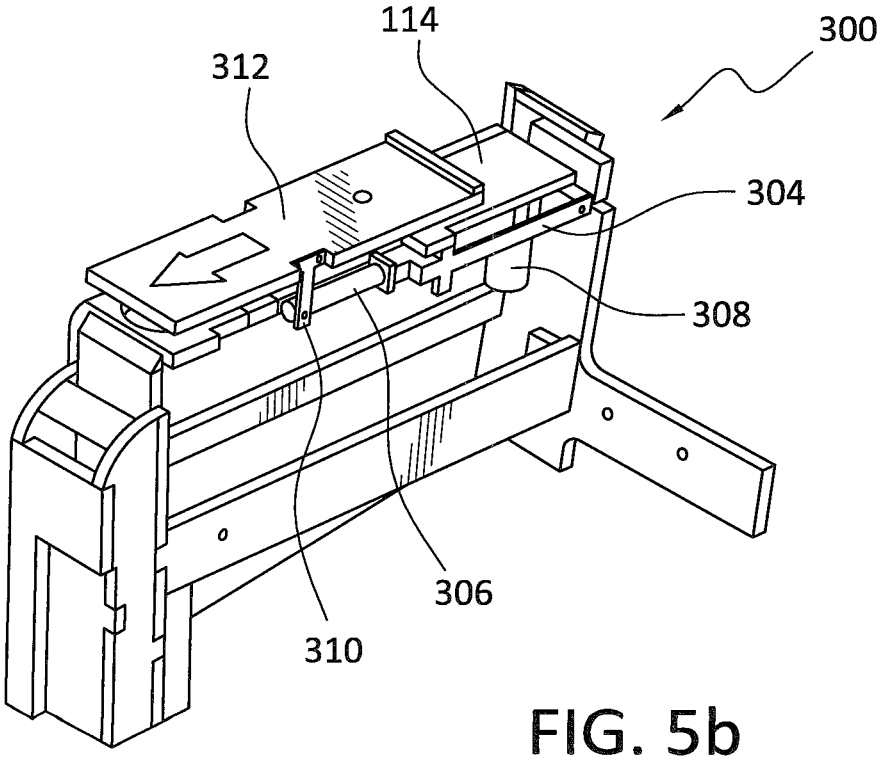
FIG. 5*b* is a schematic right side, front, top perspective view of the lounger chair as disclosed within FIGS. 4*a* and 4*b*, wherein the actuating mechanism, as disclosed within

Referring now to the drawings, and more particularly to FIGS. 1 and 2 thereof, a first embodiment of a new and improved furniture piece which comprises, for example, a lounger chair, is disclosed and is generally indicated by the reference character 100. As is conventional with such lounger chairs 100, the typical lounger chair 100 comprises a backrest cushion 102, at least one side wall portion 104 of the lounger chair frame 106, and at least one arm rest 108 formed upon an upper region of the at least one side wall portion 104 and upon which a person 110, seated within the lounger chair 100, can rest his or her arm 112. More particularly, in accordance with the principles and teachings of the present invention, it is to be appreciated that the arm rest 108 actually comprises a lower fixed arm segment 114, and an upper slidably movable arm segment 116. The upper slidably movable arm segment 116 is adapted to be moved rearwardly to a first normally OPEN position, as illustrated within FIG. 1, at which it can be seen to uncover a storage receptacle or cup holder 118 formed within the lower fixed arm segment 114 so as to render the storage receptacle or cup holder 118 readily accessible, and to be moved forwardly to a second CLOSED position, as illustrated within FIG. 2, at which it can be seen that the storage receptacle or cup holder 118 formed within the lower fixed arm segment 114 are now covered and rendered inaccessible. It is also to be noted that the rear end portion 120 of the upper slidably movable arm segment 116 has a height or thickness dimension which is relatively smaller than the height or thickness dimension of the forward end portion of the upper slidably movable arm segment 116. In this manner, the forward end portion of the upper slidably movable arm section 116 is provided with an enhanced amount of padding so as to provide a sufficient amount of comfort for the arm 112 of the person 110 seated in the lounger chair 100. Still further, it is also noted that the side wall portion 104 of the lounger chair 100 is provided with a rearwardly disposed, upstanding stop member 122 which effectively serves as a limit stop with respect to how far the upper slidably movable arm segment 116 can be moved to its rearwardmost position, as well as an opening, recess, or socket portion 124 for accommodating the rear end portion of the upper slidably movable arm segment 116 when the same is moved to its rearwardmost position.

With reference now being made to FIGS. 3*a*-4*b*, actuating mechanisms for moving the upper slidably movable arms from their OPEN positions to their CLOSED positions and back to the OPEN positions will now be described. The actuating mechanisms may comprise one of two different embodiments. In accordance with a first embodiment of a suitable actuating mechanism, as disclosed within FIGS. 3*a* and 3*b* and as generally indicated by the reference character 200, the actuating mechanism 200 may comprise a linear actuator which may be, for example, a rotary driven screw-threaded actuator mechanism 202 comprising an actuator housing 204 from which a threaded rod 206 is extended or retracted axially when the actuator mechanism 200 is rotated in first and second directions by means of a bi-directional drive motor 208, and wherein the distal end portion of the threaded rod 206 engages a dependent mounting bracket 210 which is fixedly attached to an upper mounting plate 212 upon which the upper slidably movable arm segment is fixedly mounted. The upper mounting plate 212 is, in turn, fixedly mounted to a slidably movable rail member 214 which is sliably disposed atop a fixed support plate 216. Accordingly, when the threaded rod 206 of the actuator mechanism 202 is extended as disclosed within FIG. 3*b*, the distal end portion of the threaded rod 206 will engage the mounting bracket 210 such that the upper slidably movable arm segment, attached to the upper mounting plate 212, will be moved forwardly so as to be disposed at its fully CLOSED position at which time, for example, the at least one cup holder 118, disposed within the lower, fixed arm segment 114 will be covered, hidden, and rendered inaccessible.

A biasing spring 218 is fixedly secured at one end thereof to the actuator housing 204 and is likewise fixedly secured at its opposite end to the mounting bracket 210. Accordingly, when the bi-directional drive motor 208 is rotated in the opposite direction, the threaded rod 206 will be retracted into the actuator housing 204, thereby permitting the biasing spring 218 to return the upper slidably movable arm segment to its rearward OPEN position at which time the storage receptacle or cup holder 118 will be uncovered and readily accessible. Safety is inherently built into this system in view of the fact that if some foreign object becomes interposed between the rear end portion of the upper slidably movable arm segment 116, and any component part of the lounger chair housing or chassis 102, such as, for example, if a foreign object becomes disposed within the space, recess, or socket 124 into which the rear end portion of the upper slidably movable arm segment 116 is to be disposed when the upper slidably movable arm segment 116 is moved rearwardly, the threaded rod 206 will continue to be retracted into the actuator housing 204, however, the return spring 218 is not strong enough to overcome the interdisposition of the foreign object between the rear end portion of the upper slidably movable arm segment 116 and the space, recess, or socket 124 into which the rear end portion of the upper slidably movable arm segment 116 is to be disposed, so as to forcefully return the upper slidably movable arm segment 116 to its rearwardmost position at which the storage receptacle or cup holder are fully OPEN and uncovered. This safety feature prevents any harm being done to the foreign object, which could be animate or inanimate, until the same is removed from its obstructive disposition between the rear end portion of the upper slidably movable arm segment 116 and the space, recess, or socket 124 into which the rear end portion of the upper slidably movable arm segment 116 is to be disposed. It is lastly noted that the drive motor 208 is controlled by means of a portable, hand-held remote-control unit 220.

With reference lastly being made to FIGS. 4*a*-5*b* a second embodiment of a suitable actuating mechanism is disclosed and is generally indicated by the reference character 300. The actuating mechanism 300 may comprise a linear actuator which may be, for example, a rotary driven screw-threaded actuator mechanism 302 comprising an actuator housing 304 from which a threaded rod 306 is extended or retracted axially when the actuator mechanism 300 is rotated in first and second directions by means of a bi-directional drive motor 308, and wherein the distal end portion of the threaded rod 306 is operatively connected to a dependent mounting bracket 310 which is fixedly attached to an upper mounting plate 312 upon which the upper slidably movable arm segment is fixedly mounted. The upper mounting plate 312 is, in turn, fixedly mounted to a slidably movable rail member 314 which is sliably disposed atop a fixed support plate 316. Accordingly, when the threaded rod 306 of the actuator mechanism 302 is extended as disclosed within FIG. 3*b*, the distal end portion of the threaded rod 306, which is connected to the dependent mounting bracket 310, will move the same such that the upper slidably movable arm segment, attached to the upper mounting plate 312, will be moved forwardly so as to be disposed at its fully CLOSED position at which time, for example, the at least one cup holder 118, disposed within the lower, fixed arm segment 114 will be covered, hidden, and rendered inaccessible.

It is to be noted that the first and second embodiments of the actuating mechanisms 200,300 are substantially the same with three exceptions. The first exception is that within the second actuating system 300, the return biasing spring 218 has been eliminated. The second exception is that a power control unit 322 has been electronically interposed between the remote control 320 and the drive motor 308. The third exception, as has been noted, is that the threaded rod 306 of the second actuating mechanism 300 is fixedly connected to the mounting bracket 310 as opposed to simply engaging the mounting bracket 310 as was the case of the first embodiment actuating system 200. Accordingly, when the drive motor 308 is driven in the reverse direction, it will directly pull upon the mounting bracket 310. Therefore, if a foreign object becomes interposed between rear end portion of the upper slidably movable arm segment 116, and any component part of the lounger chair housing or chassis 102, such as, for example, if a foreign object becomes disposed within the space, recess, or socket 124 into which the rear end portion of the upper slidably movable arm segment 116 is to be disposed when the upper slidably movable arm segment 116 is moved rearwardly, continued operation of the drive motor 308 can be dangerous.

Therefore, the drive motor 308 is electronically monitored by means of the power control unit 322 which monitors the RPM of the drive motor 308 as well as the amperage drawn by the drive motor 308. If either of these parameters exceeds the limits pre-programmed into the power control unit 322, which would indicate that the rotary drive motor 308 is attempting to drive the threaded rod with greater power than is normal so as to, for example, overcome an obstacle that may have become interposed between the rear end portion of the upper slidably movable arm segment 116 the space, recess, or socket 124 into which the rear end portion of the upper slidably movable arm segment 116 is to be disposed when the upper slidably movable arm segment 116 is moved rearwardly, the rotary drive of the drive motor 308 is immediately reversed or terminated until the foreign object has been removed. This safety feature therefore operates in a similar manner so as to prevent the drive motor 308 from being burned out due to excessive operation beyond acceptable power limits, and also prevents any harm being done to the foreign object, which could be animate or inanimate, until the same is removed from its obstructive disposition between the rear end portion of the upper slidably movable arm segment 116 the space, recess, or socket 124 into which the rear end portion of the upper slidably movable arm segment 116 is to be disposed when the upper slidably movable arm segment 116 is moved rearwardly.

Obviously, many variations and modifications of the present invention are possible in light of the above teachings. For example, while the disclosure has been directed toward lounger chairs, the principles and teachings of the present invention are likewise applicable to other chairs or other furniture pieces. It is therefore to be understood that within the scope of the appended claims, the present invention may be practiced otherwise than as specifically described herein.

REFERENCE NUMBER KEY

100—Lounger chair
102—Backrest cushion of lounger chair
104—Side wall portion of lounger chair framework
106—Lounger chair framework
108—Arm rest
110—Person sitting in lounger chair
112—Arm of person sitting in chair and resting upon either arm rest segment
114—Lower fixed arm rest segment
116—Upper slidably movable arm rest segment
118—Cup holder formed within lower fixed arm rest segment
120—Rear end portion of upper slidably movable arm rest segment
122—Rear stop member of side wall portion of lounger chair framework
124—Recess or socket space for accommodating rear end portion of 116
200—First embodiment actuating mechanism
202—First embodiment linear actuator
204—Housing of linear actuator
206—Extensible/retractable threaded rod of linear actuator
208—Drive motor for linear actuator
210—Dependent mounting bracket
212—Upper mounting plate upon which upper arm segment is fixedly secured
214—Slidable rail member
216—Fixed support plate upon which slidable rail member is movable
218—Biasing return spring
220—Portable hand-held remote control for lounger chair
300—Second embodiment actuating mechanism
202—Second embodiment linear actuator
304—Housing of linear actuator
306—Extensible/retractable threaded rod of linear actuator
308—Drive motor for linear actuator
310—Dependent mounting bracket
312—Upper mounting plate upon which upper arm segment is fixedly secured
314—Slidable rail member
316—Fixed support plate upon which slidable rail member is movable
320—Portable hand-held remote control for lounger chair
322—Power control unit

The invention claimed is:

1. An article of furniture, comprising:

a framework;

at least one arm fixedly mounted upon said framework, wherein said arm comprises a lower fixed arm segment having a storage receptacle/cup holder disposed therein, and an upper arm segment slidably mounted only in a linear horizontal plane upon said lower fixed arm segment so as to be movable between a first forward position at which said upper slidably movable arm segment moves to a CLOSED position at which said upper slidably movable arm segment covers said storage receptacle/cup holder disposed within said lower fixed arm segment such that said storage receptacle/cup holder is hidden from view and is rendered inaccessible while said upper arm segment also serves as an arm rest, and a second rearward position at which said upper slidably movable arm segment moves rearwardly to an OPEN position at which said upper slidably movable arm segment uncovers said storage receptacle/cup holder disposed within said lower fixed arm segment such that said storage receptacle/cup holder is rendered accessible; and a motorized mechanism operatively connected to said upper slidably movable arm segment for moving said upper slidably movable arm segment from said first CLOSED position at which said storage receptacle/cup holder is hidden from view within said lower fixed arm segment, to said second OPEN position at which said upper slidably movable arm segment uncovers said storage receptacle/cup holder such that said storage receptacle/cup holder is accessible.

2. The article of furniture as set forth in claim 1, wherein: said cup holder is provided for holding at least one beverage.

3. The article of furniture as set forth in claim 1, wherein: said motorized mechanism comprises a linear actuator.

4. The article of furniture console as set forth in claim 3, wherein:

said linear actuator comprises a bi-directional drive motor.

5. The article of furniture as set forth in claim 4, wherein:

a mounting bracket is fixedly secured to said upper slidably movable arm segment;

one end of said linear actuator is operatively connected to said mounting bracket so as to cause said compartment door to be moved to said OPEN position and back to said CLOSED position; and a power control unit operatively connected to said drive motor so as to limit the power generated by said drive motor if said compartment door becomes jammed so as not to burn out said drive motor.

6. The article of furniture as set forth in claim 3, wherein:

a mounting bracket is fixedly secured to said upper slidably movable arm segment;

one end of said linear actuator is adapted to engage said mounting bracket so as to cause said upper slidably movable arm segment to be moved to said CLOSED position; and a return spring operatively connected to said mounting bracket so as to return said compartment door from said CLOSED position to said OPEN position.

7. The article of furniture as set forth in claim 1, further comprising:

a mounting plate upon which said upper slidably movable arm segment is fixedly attached;

a slidable rail member to which said mounting plate is fixedly attached; and a support plate mounted upon said lower fixed arm segment of said arm rest and upon which said slidable rail member slides when said upper slidably movable arm segment is moved between said first forward CLOSED position and said second rearward OPEN position.

* * * * *